US007467729B2

(12) United States Patent
Lown et al.

(10) Patent No.: US 7,467,729 B2
(45) Date of Patent: Dec. 23, 2008

(54) TOTES FOR BOTTLES

(75) Inventors: Aaron Lown, Tuxedo, NY (US); John R. Swartz, Ridgewood, NJ (US)

(73) Assignee: Built NY, Inc., New York, NY (US)

( * ) Notice: Subject to any disclaimer, the term of this patent is extended or adjusted under 35 U.S.C. 154(b) by 0 days.

(21) Appl. No.: 11/676,587

(22) Filed: Feb. 20, 2007

(65) Prior Publication Data

US 2007/0141876 A1 Jun. 21, 2007

Related U.S. Application Data

(63) Continuation of application No. 10/816,676, filed on Apr. 2, 2004, now Pat. No. 7,219,814.

(60) Provisional application No. 60/535,443, filed on Jan. 9, 2004.

(51) Int. Cl.
*B65D 25/34* (2006.01)
*B65D 75/00* (2006.01)

(52) U.S. Cl. ..... 220/739; 206/427; 220/592.2; 220/903; 383/38

(58) Field of Classification Search ..... 206/427; 220/513, 516, 592.17, 592.2, 737, 739, 903; 383/6–8, 38, 39, 109, 110, 118, 121–124
See application file for complete search history.

(56) References Cited

U.S. PATENT DOCUMENTS 665,942 A 1/1901 Tabler
1,808,375 A 6/1931 Plooster
1,983,418 A 12/1934 Thurmer
2,123,031 A 7/1938 Weiner
2,297,375 A 9/1942 Vogt
2,405,517 A 8/1946 Plummer
2,473,429 A 6/1949 Hinman
3,454,211 A * 7/1969 Hoffman ..... 383/108
3,559,873 A 2/1971 Hart
3,812,962 A 5/1974 Cunningham
3,954,177 A 5/1976 Faust
4,062,392 A 12/1977 Ishii
4,125,220 A * 11/1978 Suominen ..... 383/9
4,180,111 A 12/1979 Davis
4,197,890 A 4/1980 Simko
D266,048 S 9/1982 Zills
4,418,733 A * 12/1983 Kallman ..... 383/11
4,428,484 A 1/1984 Rattay et al.
4,542,826 A 9/1985 Adams
4,601,390 A 7/1986 Rosenthal
D289,128 S 4/1987 Bradshaw (Continued)

*Primary Examiner*—Luan K Bui
(74) *Attorney, Agent, or Firm*—Lackenbach Siegel, LLP

(57) ABSTRACT

According to another aspect of the present disclosure, a carrier for transporting a bottle or bottles, is provided. The carrier includes a tote having a non-rigid front and rear panel secured to one another along a right side terminal edge, a left side terminal edge and a bottom terminal edge to thereby define a pocket having an open top. A contact line is provided between the right side terminal edge and the left side terminal edge to divide the pocket into a first and a second pocket. The bottom terminal edge is scalloped such that each of the first and second pockets is in operative association with a lobe of the scalloped bottom terminal edge, wherein the tote is fabricated from neoprene.

1 Claim, 9 Drawing Sheets

U.S. PATENT DOCUMENTS 4,681,225 A 7/1987 Schuster
4,696,402 A * 9/1987 Harmon et al. ..... 229/120.011
4,696,403 A 9/1987 Hoover
4,696,404 A 9/1987 Corella
4,750,639 A 6/1988 Schaerer
4,819,793 A 4/1989 Willard
4,872,766 A 10/1989 Dancy
4,884,683 A 12/1989 Ford
4,955,516 A 9/1990 Satterfield
4,984,662 A 1/1991 Jacober
5,044,699 A 9/1991 Duty
5,050,998 A 9/1991 Wachtel
5,090,526 A 2/1992 Jacober
5,110,020 A 5/1992 Uhl
5,313,807 A 5/1994 Owen
D357,845 S 5/1995 Herszenberg
5,503,476 A 4/1996 Hamdan
5,624,048 A 4/1997 Sander
D379,119 S 5/1997 Wolfe et al.
5,791,481 A 8/1998 Thomas
5,848,734 A 12/1998 Melk
5,860,525 A 1/1999 Bellehchili
D409,450 S 5/1999 Hamilton
D414,083 S 9/1999 Hamilton
6,004,033 A * 12/1999 Cirone ..... 383/24
6,062,434 A 5/2000 Melk
6,068,402 A 5/2000 Freese et al.
6,131,780 A 10/2000 Becker
D433,802 S 11/2000 Graham
6,155,715 A 12/2000 Gee
D441,612 S 5/2001 Hamilton
D451,665 S 12/2001 Phillips et al.
6,401,993 B1 6/2002 Andrino
D462,164 S 9/2002 Phillips
D469,956 S * 2/2003 Cone et al. ..... D3/303
D474,887 S 5/2003 Forster
6,729,758 B1 * 5/2004 Carter ..... 383/103
6,921,203 B2 * 7/2005 Versluys ..... 383/104
2001/0031104 A1 10/2001 Vazquez
2002/0166779 A1 11/2002 Etesse et al.
2003/0128897 A1 7/2003 Lehrman
2003/0185465 A1 10/2003 Vazquez
2003/0228072 A1 12/2003 Tyberg
2005/0028910 A1 2/2005 Duty

* cited by examiner

TOTES FOR BOTTLES

CROSS REFERENCE TO RELATED APPLICATIONS

This application is a continuation of U.S. patent Ser. No. 10/816,676 filed Apr. 2, 2004, now U.S. Pat. No. 7,219,814, which in turn claims benefit of U.S. Provisional Ser. No. 60/535,443 filed Jan. 9, 2004, the entire contents of each of which are herein incorporated by reference.

BACKGROUND

1. Technical Field

The present disclosure relates to portable bottle carriers and, more particularly, to tote bags suitable for carrying at least one bottle of wine.

2. Background of Related Art

Heretofore, when carrying wine bottles in a paper bag, sack or the like, the glass wine bottles, unless restrained or held separated in the bag, could jostle against each other with the result that one or more bottles may break. Even if the bag is carefully handled to prevent breakage of the bottles, the bottles still may strike against each other such that a ringing or other irritating sound is produced. Moreover, the relatively thin nature of the paper bag or sack renders the bottles contained therein vulnerable to breakage as the result of the paper bag or sack striking and/or banging against another object. In addition, paper bags or sacs are incapable of independently retaining the bottle therein, thereby resulting in bottles slipping out of or otherwise disassociating from the paper bag or sack upon transport thereof.

Conventional bags and/or sacs are incapable of regulating and/or maintaining the temperature of the bottle retained therein for an extended period of time. In addition, conventional bags and/or sacs are incapable of protecting and/or otherwise cushioning the bottle against impacts and the like.

A need therefore exists for a portable wine bottle carrier which reduces the tendency of breakage of the bottles being transported therein, which prevents the bottles from striking one another so as to eliminate any irritating sounds resulting therefrom, and/or which reduces the tendency for bottles to become disassociated therefrom. Such carrier desirably should be conveniently totable and desirably should be aesthetically pleasing in appearance.

SUMMARY

The present disclosure relates to portable bottle carriers (i.e., tote bags) for carrying at least one bottle therein, preferably a bottle of wine therein.

According to one aspect of the present disclosure, a tote for carrying and transporting a bottle or bottles, is provided. The tote includes a front panel defining a right side, a left side, a bottom, and a top terminal edge, and a rear panel defining a right side, a left side, a bottom, and a top terminal edge. The rear panel is secured to the front panel along at least the right side, the left side and the bottom terminal edges. The front and rear panels define a pocket therebetween. The front and/or rear panel is fabricated from an elastic, insulative, impact absorbent material. The tote has a substantially flattened condition when no bottle is disposed in the pocket thereof.

Preferably, the front and rear panels are fabricated from neoprene. The front and rear panels may have a thickness of between about 3 mm to about 5 mm. Preferably, the neoprene is sandwiched between layers of stretch nylon.

The bottom terminal edges of the front and rear panels are arcuate when the tote is in the flattened condition. Accordingly, when a bottle is at least partially inserted into the opening between the front and rear panels, the arcuate bottom terminal edge thereof flattens.

Preferably, the front and rear panels are secured to one another by at least one of stitching, adhering, welding, and stapling. Desirably, at least one of the front and rear panels includes an aperture formed therein. The upper terminal edges of the front and rear panels may be arcuate.

In one embodiment, the front panel and the rear panel are secured to one another along a contact line positioned between the right side terminal edges and the left side terminal edges thereof. The contact line divides the pocket between the front and rear panels into a first pocket and a second pocket. The bottom terminal edges of each of the front and rear panels is scalloped. Accordingly, a first lobe of the bottom terminal edge is in operative association with the first pocket and a second lobe of the bottom terminal edge is in operative association with the second pocket.

In another embodiment, the tote further includes a third panel defining a right side, a left side, a bottom, and a top terminal edge. Accordingly, the right side terminal edge of the front panel is secured to the left side terminal edge of the rear panel, and a portion of the bottom terminal edge of the front panel is secured to the bottom terminal edge of the rear panel; the right side terminal edge of the rear panel is secured to the left side terminal edge of the third panels, and a portion of the bottom terminal edge of the rear panel is secured to a portion of the bottom terminal edge of the third panel; and the right side terminal edge of the third panel is secured to the left side terminal edge of the front panel, and a portion of the bottom terminal edge of the third panel is secured to a portion of the bottom terminal edge of the front panel. The front, rear and third panels may be secured to one another along a contact line substantially centrally located between the right and left side terminal edges of each of the front, the rear and the third panels.

In yet another embodiment, the tote includes a first front panel defining a right side, a left side, a bottom, and a top terminal edge, and a first rear panel defining a right side, a left side, a bottom, and a top terminal edge. The first rear panel is secured to the first front panel along at least the right side, the left side and the bottom terminal edges. The first front and first rear panels are secured to one another along a first contact line positioned between the right side terminal edges and the left side terminal edges thereof. The first contact line defines a first pocket and a second pocket between the first front panel and the first rear panel. The bottom terminal edge of each of the first front and first rear panels is scalloped, wherein a first lobe of the bottom terminal edge is in operative association with the first pocket and a second lobe of the bottom terminal edge is in operative association with the second pocket.

In the present embodiment, the tote further includes a second front panel defining a right side, a left side, a bottom, and a top terminal edge, and a second rear panel defining a right side, a left side, a bottom, and a top terminal edge, the second rear panel being secured to the second front panel along at least the right side, the left side and the bottom terminal edges. The second front and second rear panels are secured to one another along a second contact line positioned between the right side terminal edges and the left side terminal edges thereof. The second contact line defines a third pocket and a fourth pocket between the second front panel and the second rear panel. The bottom terminal edges of each of the second front and second rear panels is scalloped, wherein a first lobe of the bottom terminal edge is in operative association with the third pocket and a second lobe of the bottom terminal edge is in operative association with the fourth pocket. Preferably, the first contact line is secured to the second contact line.

The tote may further include a tote strap for selectively engaging the tote. The tote strap includes a hook member for selectively engaging a support structure; and a loop extending from the hook member. The loop has sufficient length to be fed through the hand hold of the tote and for the hook member to then be fed through the loop.

According to another aspect of the present disclosure, a tote for carrying and transporting a bottle or bottles is provided. The tote includes a front panel defining a perimetral edge; and a rear panel defining a perimetral edge. The front panel is secured to the rear panel along at least a portion of the perimetral edge so as to define a pocket therebetween and an opening into the pocket. The front and rear panels are fabricated from an elastic, insulative, impact absorbent material.

The front and rear panels are preferably fabricated from neoprene laminated between two layers of stretch nylon. The front and rear panels are secured to one another along a contact line extending in a direction orthogonal to the opening. The contact line divides the pocket into a first and a second pocket, wherein the terminal edge opposite the opening is scalloped such that each of the first and second pockets is in operative association with a lobe of the scalloped terminal edge.

According to another aspect of the present disclosure, a carrier for transporting a bottle or bottles, is provided. The carrier includes a tote having a non-rigid front and rear panel secured to one another along a right side terminal edge, a left side terminal edge and a bottom terminal edge to thereby define a pocket having an open top. A contact line is provided between the right side terminal edge and the left side terminal edge to divide the pocket into a first and a second pocket. The bottom terminal edge is scalloped such that each of the first and second pockets is in operative association with a lobe of the scalloped bottom terminal edge, wherein the tote is fabricated from neoprene.

BRIEF DESCRIPTION OF THE DRAWINGS

By way of example only, preferred embodiments of the disclosure will be described with reference to the accompanying drawings, in which.

DETAILED DESCRIPTION OF PREFERRED EMBODIMENTS

Figure 1:
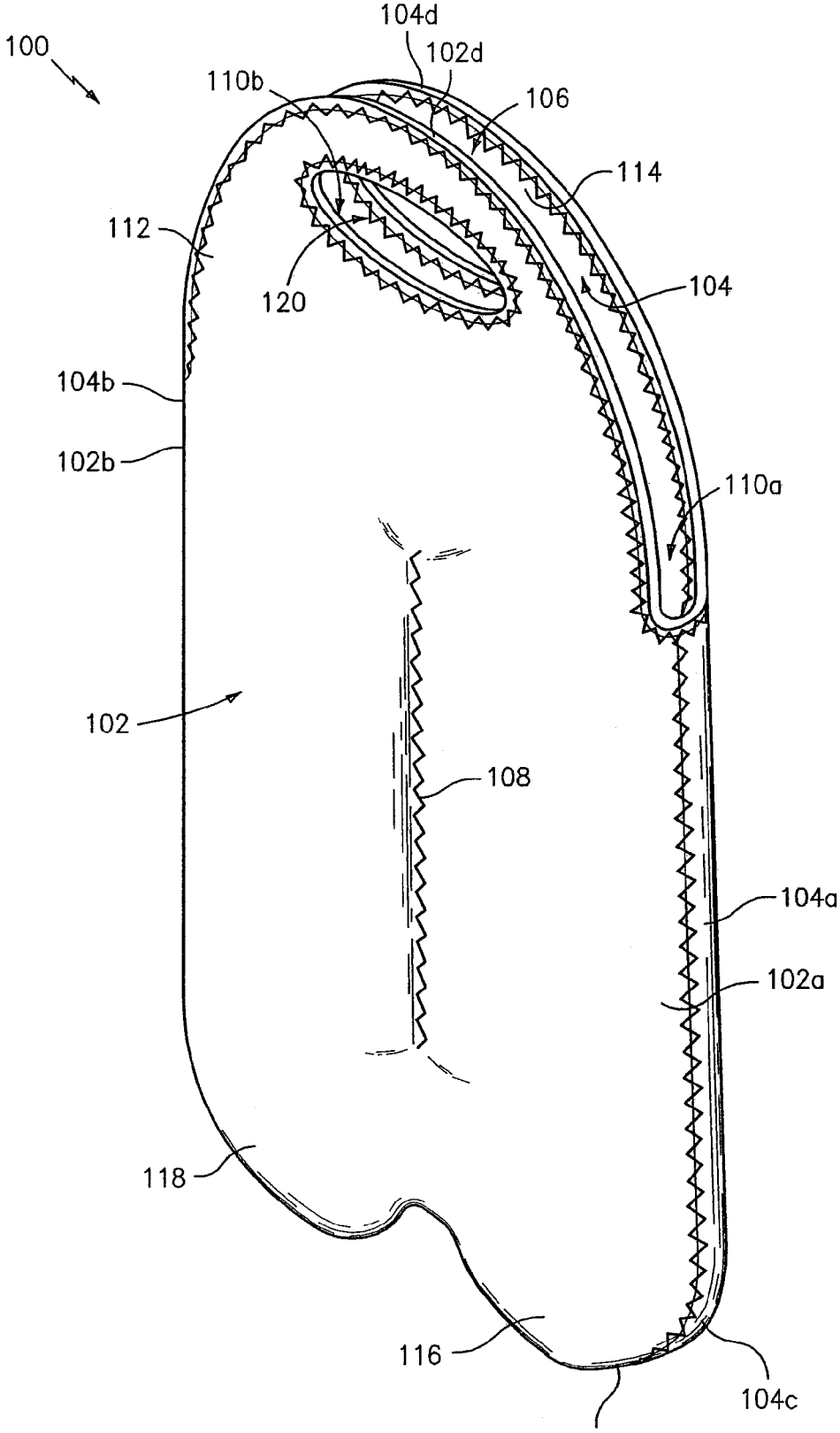
FIG. 1 is a perspective view of a tote according to an embodiment of the present disclosure, shown in a first condition.

Referring now in detail to the drawings and initially to FIGS. 1-5, a bottle tote constructed in accordance with the present disclosure is designated generally by reference numeral 100. Tote 100 includes a front panel 102 and a rear panel 104 operatively secured to one another along a number of sides thereof. Preferably, each panel 102, 104 includes a right side edge 102*a*, 104*a*, respectively, a left side edge 102*b*, 104*b*, respectively, a bottom edge 102*c*, 104*c*, respectively, and a top edge 102*d*, 104*d*, respectively.

Preferably, front panel 102 is secured to rear panel 104 along at least three side edges thereof, namely, right side edge 102*a*, 104*a*, left side edge 102*b*, 104*b*, and bottom edge 102*c*, 104*c*. Front panel 102 is preferably secured to rear panel 104 by stitching along right side edges 102*a*, 104*a*, left side edges 102*b*, 104*b* and bottom edges 102*c*, 104*c*. While stitching is preferred, it is envisioned that front panel 102 can be secured to rear panel 104 by adhering, welding, stapling and the like. Top edges 102*d*, 104*d* are preferably separated from one another to define an opening 106 into tote 100. Desirably, front panel 102 and rear panel 104 are secured (e.g., stitched, glued, welded, etc.) to one another along a contact line 108 located between right side edges 102*a*, 104*a* and left side edges 102*b*, 104*b*.

Contact line 108 is preferably longitudinally oriented to thereby define a pair of bottle receiving pockets or cavities 110*a*, 110*b*. While it is desirably that contact line 108 be centrally positioned between right side edge 102*a*, 104*a*, and left side edge 102*b*, 104*b*, to thereby define pockets 110*a*, 110*b* having substantially the same dimensions, it is envisioned and within the scope of the present disclosure for contact line 108 to be positioned closer to right side edge 102*a*, 104*a* or left side edge 102*b*, 104*b*, to thereby define pockets 110*a*, 110*b* having different dimensions from one another.

Top edges 102*d*, 104*d* of front and rear panels 102, 104 can be rounded wherein top edges 102*d*, 104*d* commence where right side edges 102*a*, 104*a* and left side edges 102*b*, 104*b* terminate, thereby defining a front flap 112 and a rear flap 114, respectively. Bottom edges 102*c*, 104*c* of front and rear panels 102, 104 are preferably scalloped, defined by a pair of lobes 116, 118. Preferably, each pocket 110*a*, 110*b* of tote 100 is in registration with a respective lobe 116, 118 (i.e., contact line 108 is axially aligned with the intersection of lobes 116, 118). As will be discussed in greater detail below, lobes 116, 118 allow tote 100 to: 1) store flat when not in use; and 2) stand upright when bottles are fully inserted therein.

Each panel 102, 104 of tote 100 is preferably fabricated from neoprene rubber, more preferably, CR+(100%) neoprene rubber having stretch nylon laminated to the front and back thereof. Each panel 102, 104 preferably has a thickness of between about 3 mm to about 5 mm. The neoprene rubber material acts as a shock absorber to dissipate and/or otherwise absorb forces which may impact on tote 100. Fabrication of tote 100 from neoprene rubber material allows for tote 100 to be fabricated with no moving parts or separate parts/hardware and yet at the same time substantially grip the bottle retained therein. Since the neoprene rubber material has a degree of resiliency, tote 100 can accommodate receipt of and retention of bottles of varying sizes (e.g., bottles having uniform and/or non-uniform diameters along the length thereof, bottles of various diameters and non-circular bottles). The neoprene rubber material also provides tote 100 with a degree of insulation greater that a tote fabricated from paper or the like and thereby allows tote 100 to better maintain the temperature of the bottle(s) retained therein.

Desirably, front panel 102 and rear panel 104 includes an aperture 120 formed therein defining a hand hold. Preferably, if tote 100 is fabricated from a neoprene rubber material, the hand hold is provided with a degree of comfort for the carrier.

Figure 2:
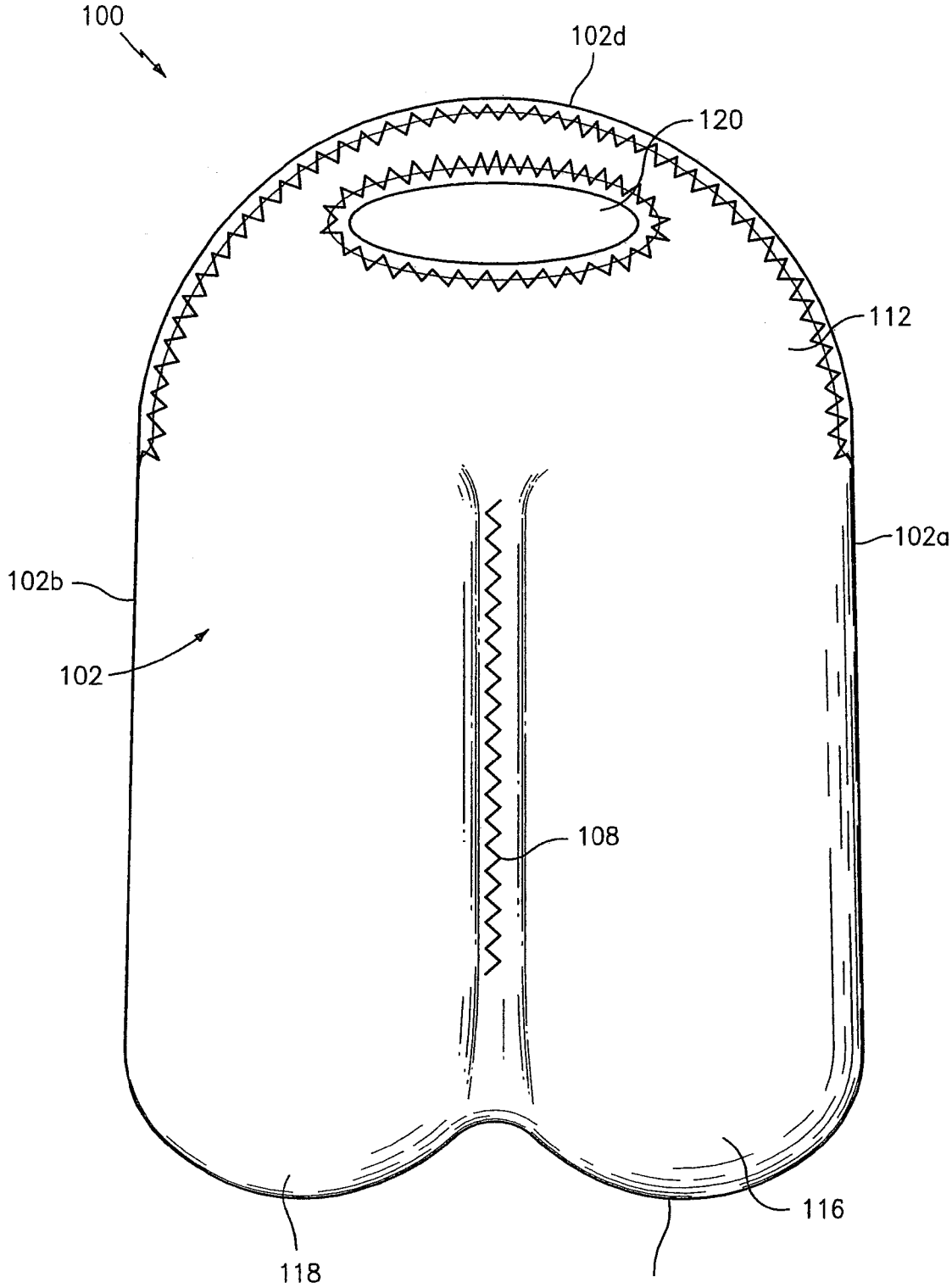
FIG. 2 is a plan view of the tote of FIG. 1.

As seen in FIGS. 1 and 2, tote 100 has a first configuration wherein tote 100 is substantially flat, i.e., front panel 102 is at least substantially in contact with rear panel 104. In this manner, when tote 100 is not in use, tote 100 can advantageously be stored in a substantially flat configuration, rolled-up, or otherwise manipulated as needed.

Figure 3:
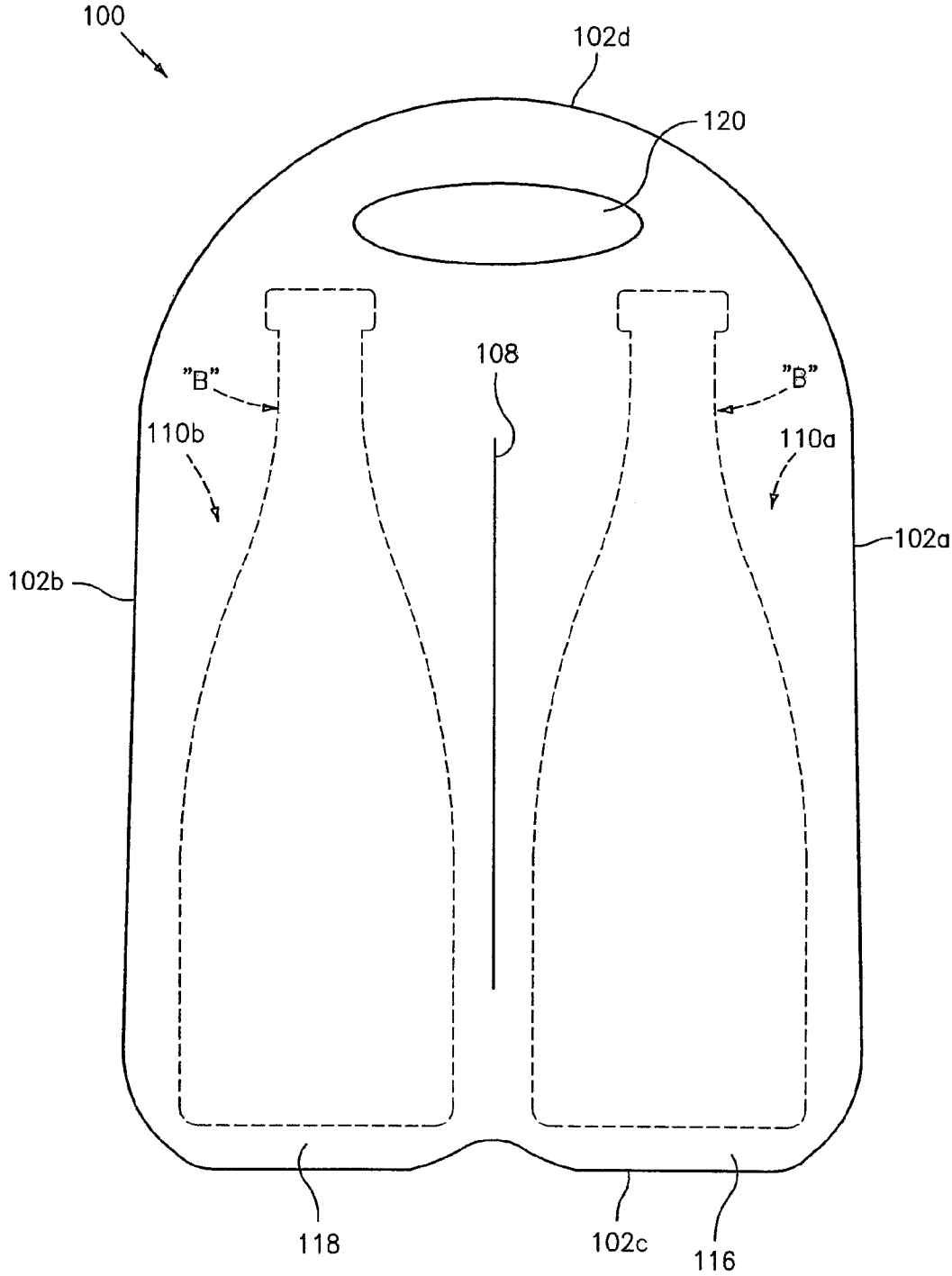
FIG. 3 is a plan view of the tote of FIGS. 1 and 2, in a second condition including a pair of bottles retained therein.
Figure 4:
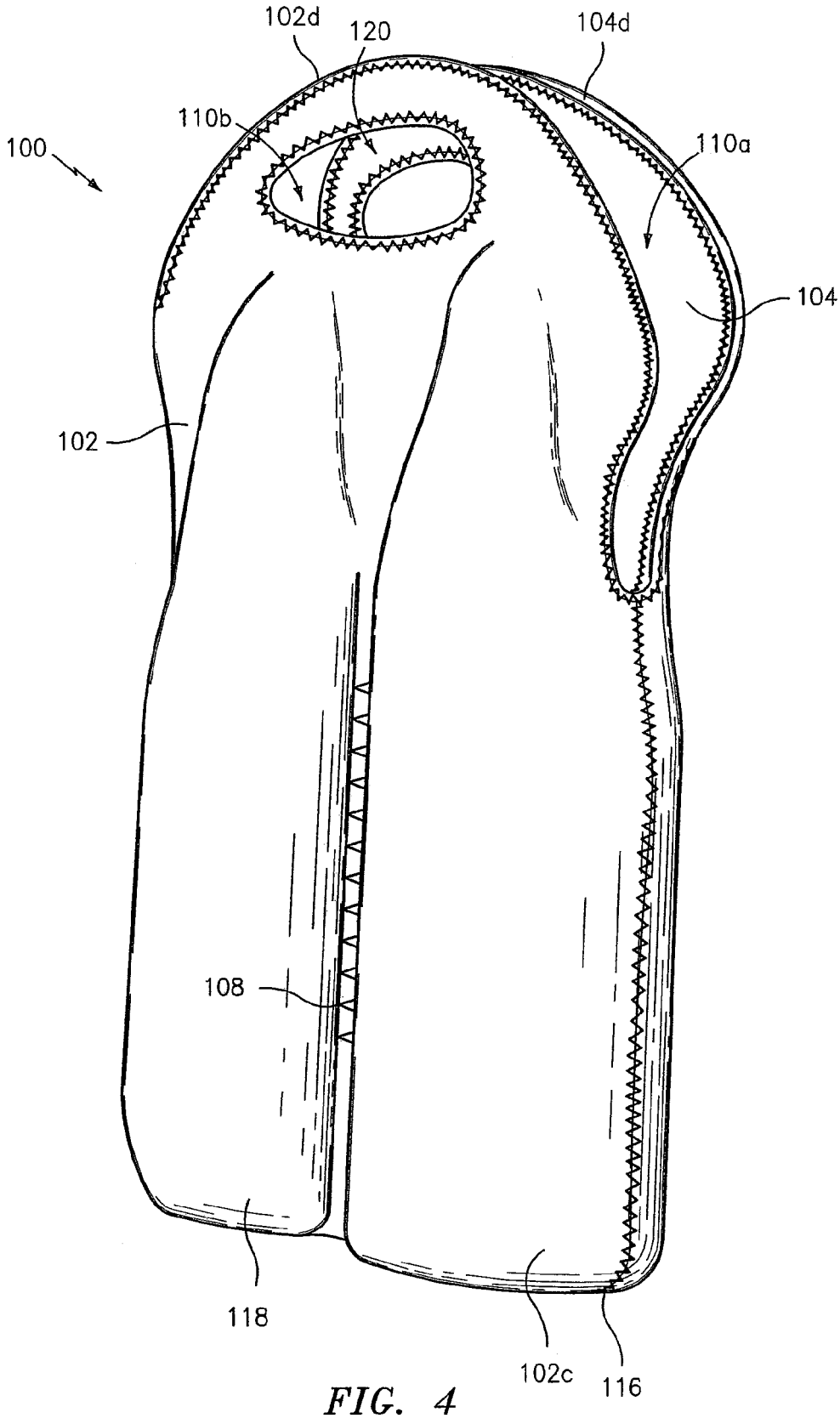
FIG. 4 is a perspective view of the tote of FIGS. 1-3, while in the second condition.
Figure 5:
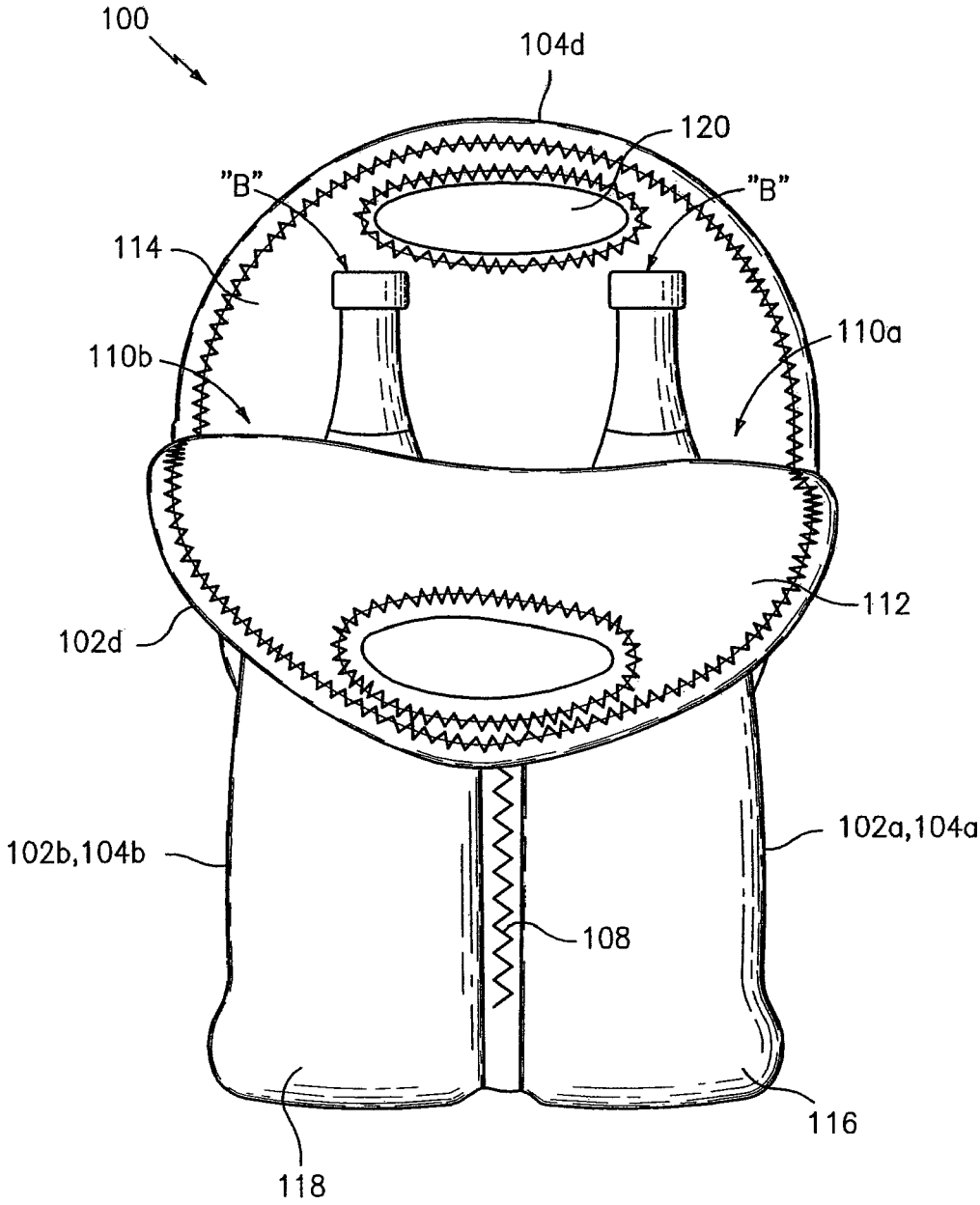
FIG. 5 is a front elevational view of the tote of FIGS. 1-4, while in the second condition, with a flap thereof turned down.

As seen in FIGS. 3-5, tote 100 has a second configuration wherein tote 100 substantially conforms to the shape and/or outer contour of a bottle "B" placed and/or inserted into pockets 110*a*, 110*b*. When one bottle "B", preferably two bottles "B", is/are fully inserted into one or each cavity 110*a*, 110*b*, front panel 102 is separated from rear panel 104 and the respective lobe 116, 118, advantageously flattens to allow tote 100 to stand upright.

Since tote 100 is preferably fabricated from neoprene and has a degree of elasticity, tote 100 substantially conforms to the contour and/or shape of bottles "B" and effectively grips bottles "B", thereby effectively reducing the tendency for bottles "B" to "slip out off" pockets 110*a*, 110*b*. In addition, the neoprene provides tote 100 with a degree of cushion thereby absorbing impacts and shocks which would otherwise be transmitted to bottles "B". For example, the location of contact line 108 and the size of pockets 110*a*, 110*b* may be selected to accommodate bottles "B" which are sized to hold at least 500 ml, 750 ml, 1 L and 1.5 L of fluid.

Additionally, contact line 108 separates pocket 110*a* from pocket 110*b*, thereby eliminating and/or reducing the tendency of the adjacent bottles "B" from contacting and/or otherwise banging into one another, thereby reducing the chances of breakage and reducing the incidents of clanking.

Moreover, the neoprene construction acts like an insulator to aid in the maintenance of bottles "B" in a chilled condition if desired. If desired, one pocket 110*a*, 110*b* can contain a chilled bottle "B" while the other pocket 110*a*, 110*b* can contain an un-chilled bottle "B". In this manner, the chilled bottle will remain relatively colder and the un-chilled bottle will remain relatively warmer.

Figure 6:
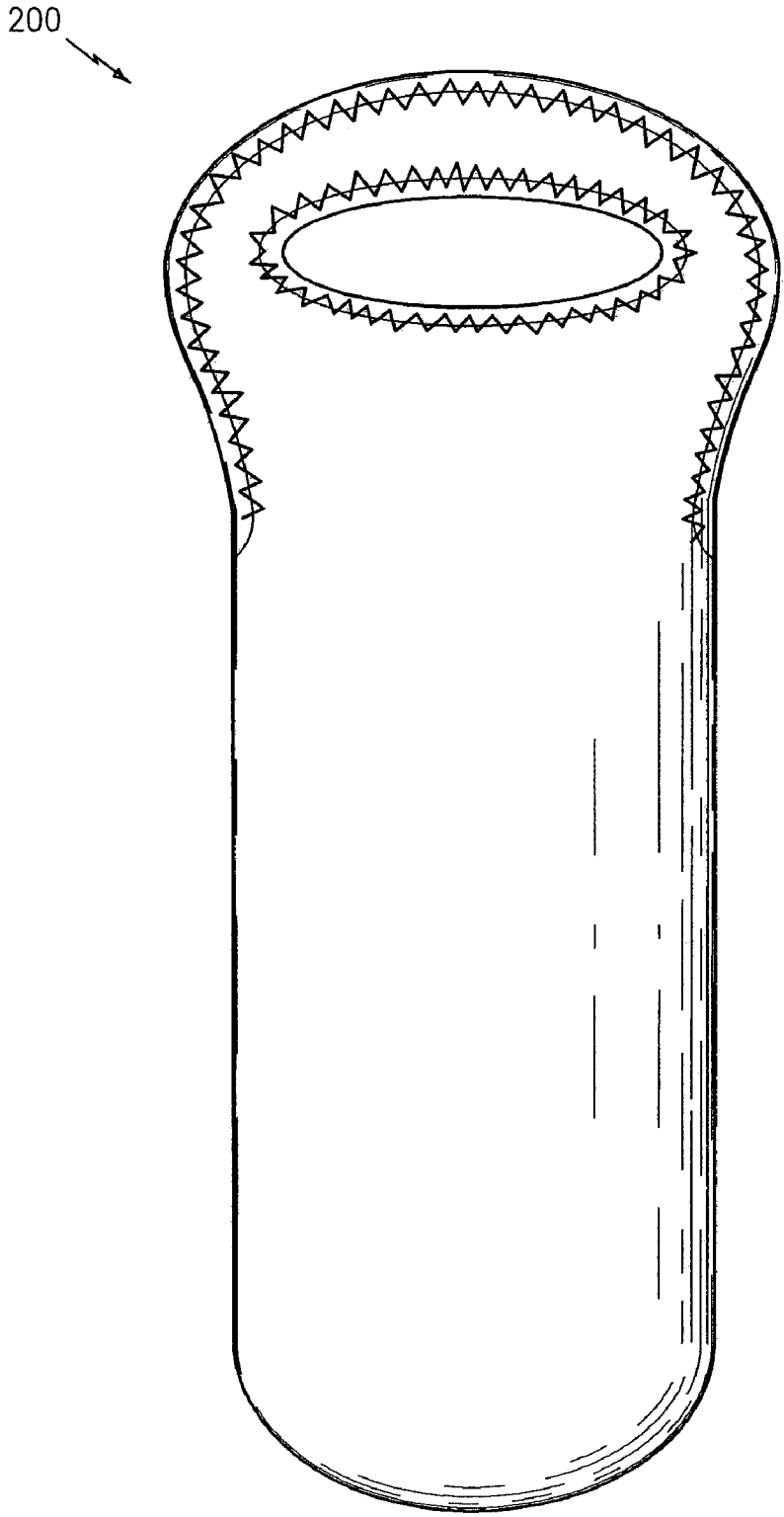
FIG. 6 is a plan view of a tote according to another embodiment of the present disclosure.

Turning now to FIG. 6, a tote in accordance with another embodiment of the present disclosure is generally designated as 200. Tote 200 is substantially similar to tote 100 except that tote 200 includes a single pocket (not shown), for retaining a single bottle therein. Similar to tote 100, tote 200 has a first configuration in which tote 200 is substantially flat and a second configuration in which tote 200 substantially conforms to the contour of the bottle placed therein. When the bottle is fully inserted into the pocket of tote 200, the bottom of tote 200 becomes substantially flat, allowing for tote 200 to stand in an upright condition.

Figure 7:
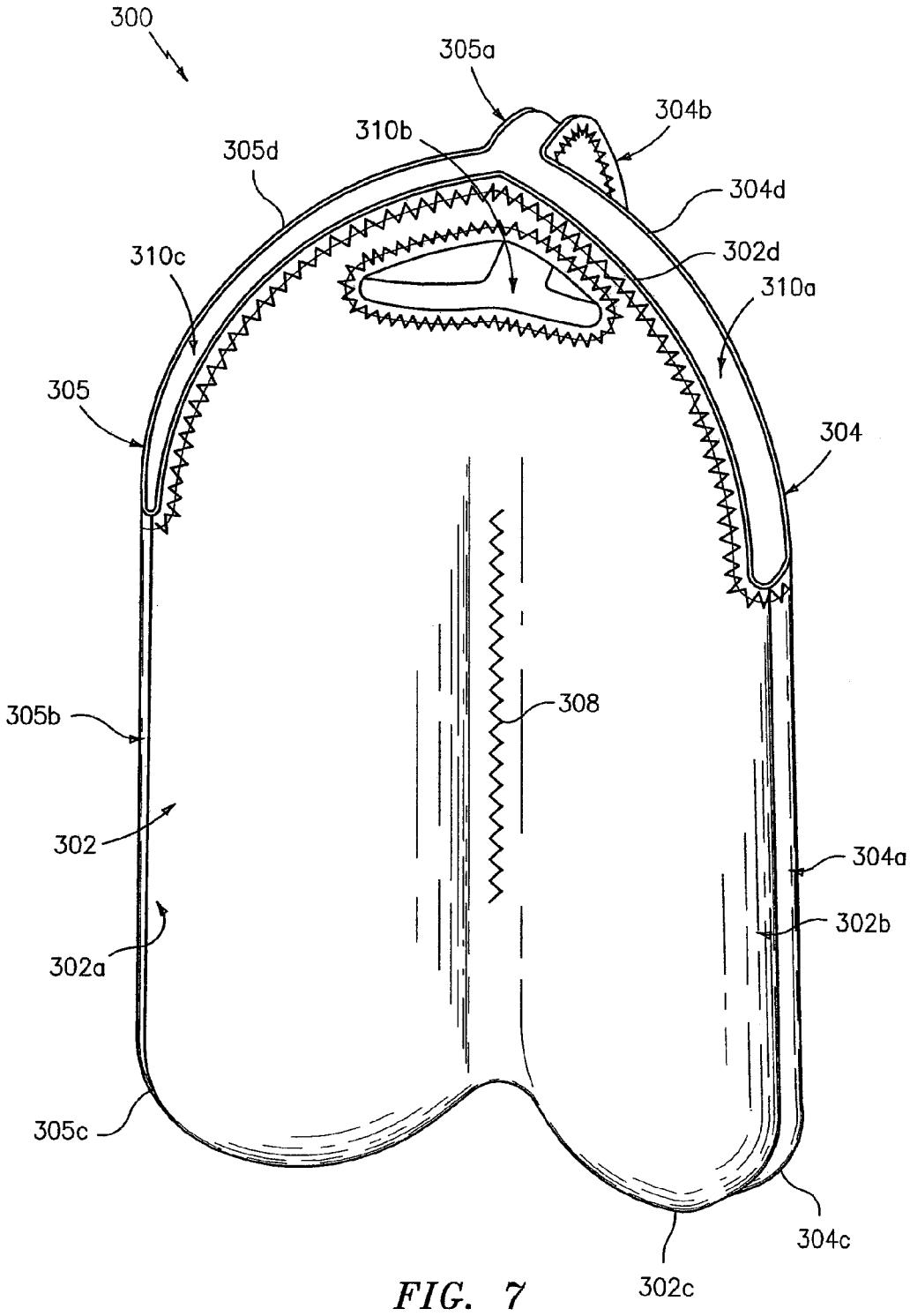
FIG. 7 is a perspective view of a tote according to yet another embodiment of the present disclosure.

Turning now to FIG. 7, a tote in accordance with yet another embodiment of the present disclosure is generally designated as 300. Tote 300 is substantially similar to tote 100 and will only be discussed in detail to the extent necessary to identify differences in construction and operation.

Tote 300 includes a first panel 302, a second panel 304, and a third panel 305 operatively secured to one another along a number of sides thereof. Preferably, each panel 302, 304 and 305 includes a side edge 302*a*, 304*a* and 305*a*, respectively, a side edge 302*b*, 304*b* and 305*b*, respectively, a bottom edge 302*c*, 304*c* and 305*c*, respectively, and a top edge 302*d*, 304*d* and 305*d*, respectively.

Preferably, first panel 302 is secured (e.g., stitched, adhered, welded, etc.) to second panel 304 along at least two side edges thereof, namely, side edge 302*b*, 304*a*, and one half of bottom edge 302*c*, 304*c*. Second panel 304 is secured to third panel 305 along at least two side edges thereof, namely, side edge 304*b* and 305*a* respectively, and one half of bottom edge 304*c* 305*c*, respectively. Third panel 305 is secured to first panel 302 along at least two side edges thereof, namely, side edge 305*b* and 302*a*, and one half of bottom edge 305*c*, 302*c*. First, second and third panels 302, 304 and 305 are preferably secured to one another along a contact line 308 substantially centrally located. Contact line 308 is preferably longitudinally oriented to thereby define three bottle receiving pockets or cavities 310*a*, 310*b* and 310*c*. Tote 300 is essentially in the form of a triad.

Figure 8:
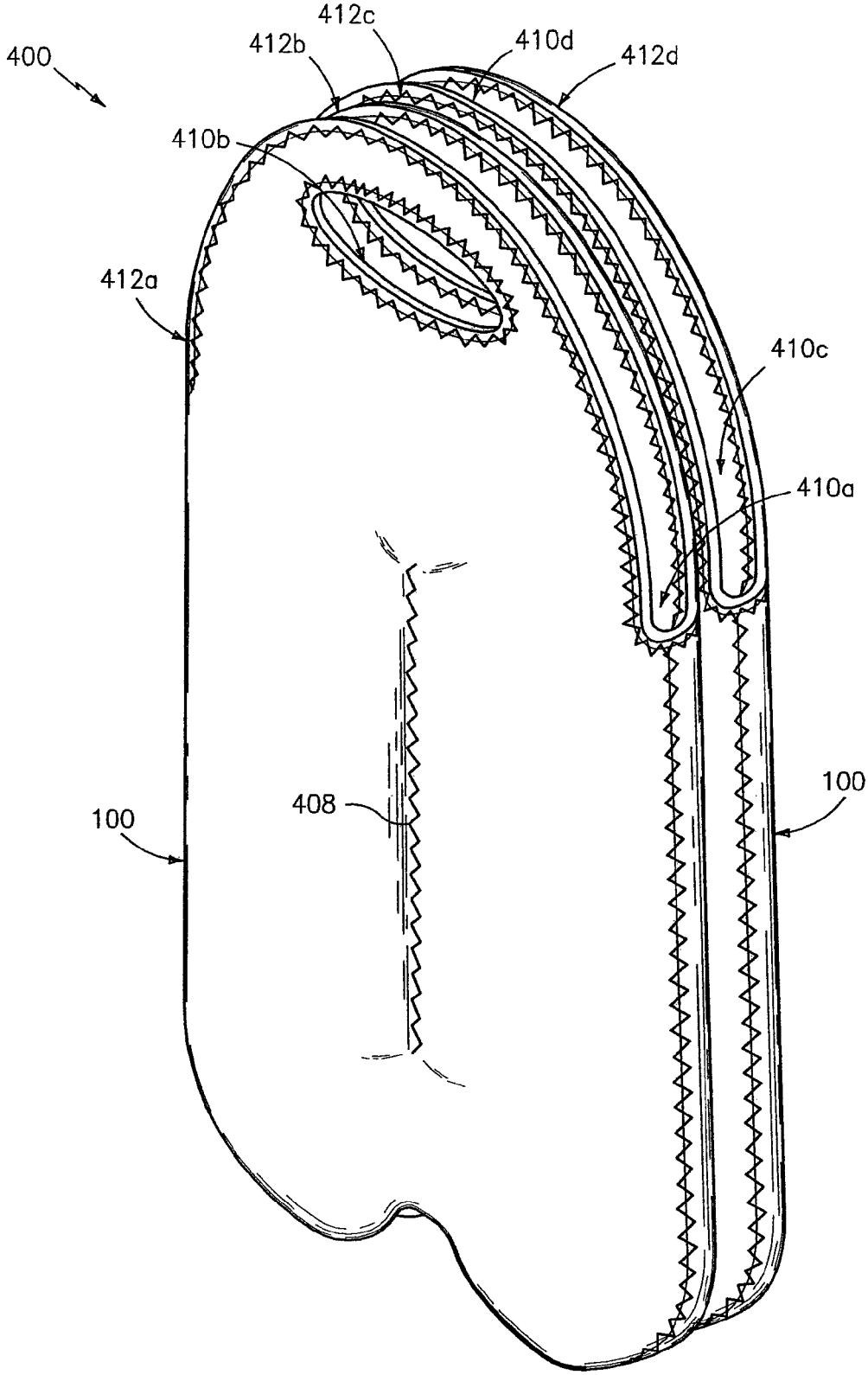
FIG. 8 is a perspective view of a tote according to still another embodiment of the present disclosure.

Turning now to FIG. 8, a tote in accordance with still another embodiment of the present disclosure is generally designated as 400. Tote 400 is substantially similar to tote 100 and will only be discussed in detail to the extent necessary to identify differences in construction and operation.

Tote 400 is essentially a pair of totes 100 operatively secured to one another. In this manner, tote 400 includes two pairs of or four bottle receiving pockets or cavities 410*a*-410*d*. While four flaps 412*a*-412*d* are shown, providing the contents of tote 400 with the maximum amount of protection, it is envisioned and contemplated that any number of flaps 412 are possible.

Similar to tote 100, tote 400 has a first configuration in which tote 400 is substantially flat, as seen in FIG. 8, and a second configuration in which tote 400 substantially conforms to the contour of bottles placed therein. When bottles are fully inserted into pockets 410*a*-410*d* of tote 400, the bottom of tote 400 becomes substantially flat, allowing for tote 400 to stand in an upright condition. Tote 400 can essentially be considered a quad tote.

Figure 9:
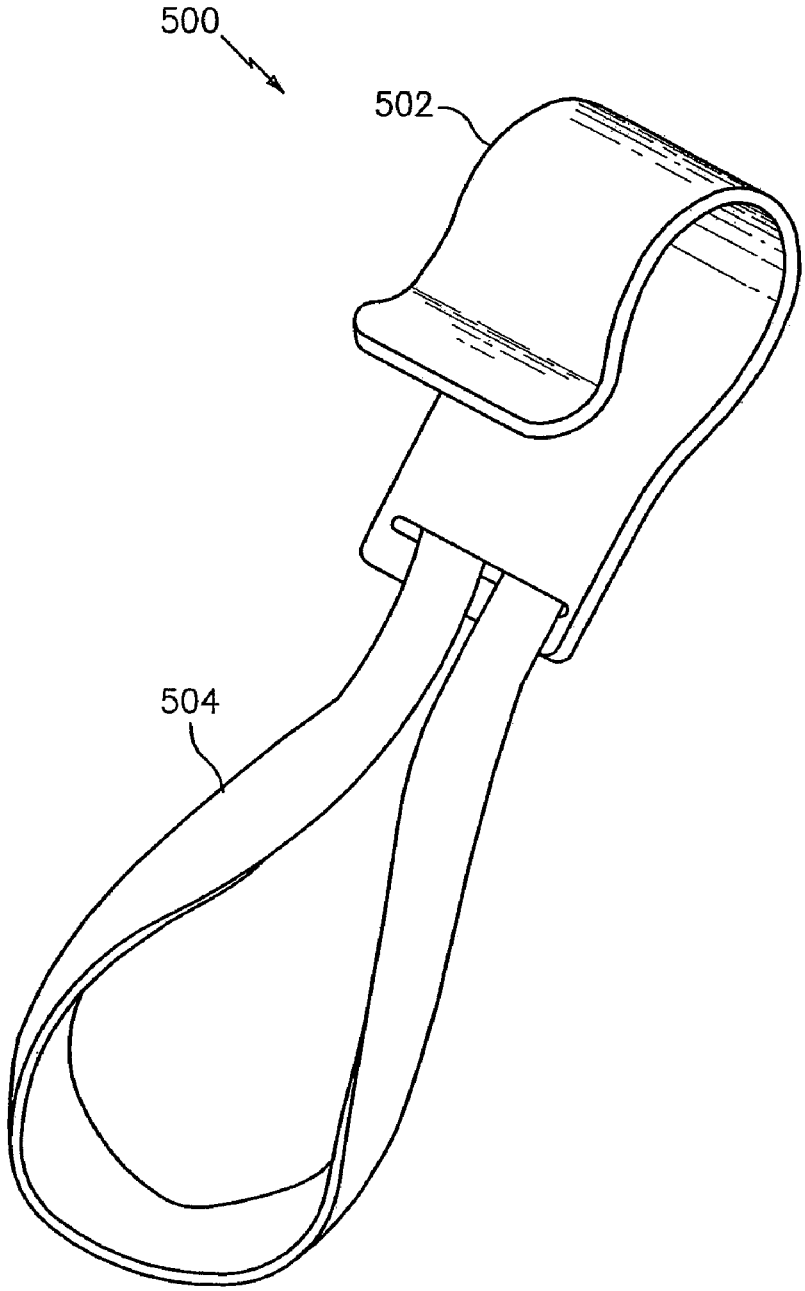
FIG. 9 is a perspective view of a tote strap for use in connection with any of the totes of the present disclosure.

As seen in FIG. 9, a tote strap 500 can be provided for attaching and/or otherwise connecting any of totes 100-400 to a rolling travel bag, a shopping cart, an vehicle or the like. Tote strap 500 includes a hook member 502 fabricated from a rigid material, e.g., rigid plastics, composites, metals and the like. Tote strap 500 further includes a loop 504 extending from hook member 502. Loop 504 preferably has a length sufficient for loop 504 to be fed through hand hold 120 of tote 100 and then hook member 502 is fed through loop 504 and pulled or cinched to thereby tighten loop 504. Hook member 502 can then be connected to the rolling baggage, the shopping cart, the vehicle or the like.

It will be understood that various modifications may be made to the embodiments disclosed herein. For example, while totes for 1-4 bottles have been shown and described, it is envisioned that totes for any number of bottles can be provided by combining any of the totes disclosed herein. Accordingly, the above description should not be construed as limiting, but merely as an exemplification of preferred embodiments. Those skilled in the art will envision other modifications within the scope and spirit of the claims appended hereto.

What is claimed is:

1. A tote for carrying and transporting a bottle or bottles, the tote comprising:

a first front panel defining a right side, a left side, a bottom, and a top terminal edge; a first rear panel defining a right side, a left side, a bottom, and a top terminal edge, the first rear panel being secured to the first front panel along at least the right side, the left side and the bottom terminal edges;

the top terminal edges are arcuate and define an opening therebetween dimensioned to receive at least one bottle and running uninterruptedly between the left and right sides of the secured first front and first rear panels;

the first front and first rear panels being secured to one another along a first contact line positioned between the right side terminal edges and the left side terminal edges thereof and extending away from said top terminal edges, wherein the first contact line defines a first pocket and a second pocket between the first front panel and the first rear panel, wherein the bottom terminal edges of each of the first front and first rear panels is scalloped into a first-first lobe and a second-first lobe;

wherein said first-first lobe of the bottom terminal edge is in operative association with the first pocket and said second-first lobe of the bottom terminal edge is in operative association with the second pocket;

wherein the top terminal edges of said first front and said first rear panels bridge upper portions of the secured left and right sides of the front and rear panels, respectively, the front and rear panels having respective flaps each bounded by the top terminal edge, the flaps each being foldable over a panel region extending between the upper portions of the respective secured left and right sides and at least one of the flaps having an aperture formed therein;

a second front panel defining a right side, a left side, a bottom, and a top terminal edge; and a second rear panel defining a right side, a left side, a bottom, and a top terminal edge;

the top terminal edges are arcuate and define an opening therebetween dimensioned to receive at least one bottle and running uninterruptedly between the left and right sides of the secured second front and second rear panels;

the second rear panel being secured to the second front panel along at least the right side, the left side and the bottom terminal edges, the second front and second rear panels being secured to one another along a second contact line positioned between the right side terminal edges and the left side terminal edges thereof and extending away from the top terminal edges thereof, wherein the second contact line defines a third pocket and a fourth pocket between the second front panel and the second rear panel, wherein the bottom terminal edges of each of the second front and second rear panels is scalloped into a second-first lobe and a second-second lobe;

wherein said second-first lobe of the bottom terminal edge is in operative association with the third pocket and said second-second lobe of the bottom terminal edge is in operative association with the fourth pocket;

wherein the top terminal edges of said second front and said second rear panels bridge upper portions of the secured left and right sides of the second front and second rear panels, respectively, the second front and second rear panels having respective flaps each bounded by the top terminal edge, the flaps each being foldable over a panel region extending between the upper portions of the respective secured left and right sides and at least one of the flaps having an aperture formed therein;

wherein the first rear panel is secured to said second front panel between said respective left and right sides thereof allowing ready transport of all four pockets together, and wherein at least one of the panels is fabricated from an elastic, insulative, impact absorbent material, and wherein the tote has a substantially flattened condition when no bottle is disposed in the pocket thereof.

* * * * *